United States Patent [19]

Dumbser et al.

[11] Patent Number: 4,519,227

[45] Date of Patent: May 28, 1985

[54] CONTROL LOCKING INSTALLATION FOR MOTOR VEHICLE DOORS

[75] Inventors: Gerhard Dumbser, Niederwerrn; Manfred Lutz; Rainer Fey, both of Schweinfurt; Kurt Weiss, Schwebheim, all of Fed. Rep. of Germany

[73] Assignee: Fichtel & Sachs AG, Schweinfurt, Fed. Rep. of Germany

[21] Appl. No.: 478,163

[22] Filed: Mar. 23, 1983

[30] Foreign Application Priority Data

Mar. 25, 1982 [DE] Fed. Rep. of Germany ..... 3210923

[51] Int. Cl.[3] ..... E05B 65/36

[52] U.S. Cl. ..... 70/264; 70/237; 70/280; 292/DIG. 3; 292/DIG. 23; 292/DIG. 25

[58] Field of Search ..... 70/262–264, 70/237, 279, 280; 292/144, 201, DIG. 3, DIG. 23, DIG. 25

[56] References Cited

U.S. PATENT DOCUMENTS

| | | | |
|---|---|---|---|
| 3,653,237 | 4/1972 | Du Rocher | 70/264 |
| 4,342,209 | 8/1982 | Kleefeldt | 70/264 |
| 4,364,249 | 12/1982 | Kleefeldt | 70/264 |

*Primary Examiner*—Robert L. Wolfe

*Attorney, Agent, or Firm*—Toren, McGeady and Stanger

[57] ABSTRACT

The central locking installation for motor vehicle door locks blocks the locking element of the door lock by means of an additional, separately controllable blocking member. The locking element and the blocking member are driven by separate electrical drives which are connected into mutually parallel-connected current paths of one common drive current circuit. The drive direction of the two drives is controlled by common switches of a pole-changing circuit which reverses the current direction. Into the current path of the drives of the blocking member there is connected a control switch by way of which these drives can be switched on selectively. In the unlocking direction and the unblocking or releasing direction a time control system controllable by means of the door key in the unlocking of the door switches on the drives of the locking element and of the blocking member simultaneously. In the locking of the door lock only the drive of the locking element is switched on in its locking direction. The control switch which switches on the drive of the blocking member in the blocking direction is actuated when the key is turned beyond the locking position of the lock.

9 Claims, 7 Drawing Figures

CONTROL LOCKING INSTALLATION FOR MOTOR VEHICLE DOORS

SUMMARY OF THE INVENTION

The invention relates to a central locking installation with anti-release catch for mechanical door locks or the like on vehicles, especially motor vehicles.

A central locking installation has already been proposed in which the central locking actuator element for the actuation of the door lock is provided with an anti-release or securing catch or blocking member which can be switched by means of the same door key, by an additional actuation thereof. A central control unit provides control commands for separate drives, for example electric motors, driving the door lock element and the securing catch. Since central locking must be operable from the exterior and also from the interior of the vehicle while the anti-release catch must be operable only from exterior, a relatively great expense for control elements, for example four relays, are required.

It is the primary object of the present invention to provide a central locking installation for motor vehicle door locks or the like, having reduced expenditure on control means.

In accordance with the present invention the central locking installation for motor vehicle door locks or the like, each having a locking element movable between a locking position, blocking said door lock and a position unlocking said door lock, comprises a first electric drive for each locking element to be driven. The first electric drive drives said locking element in a direction towards said locking position and a direction towards said unlocking position. A second electric drive moves a blocking member between a blocking position blocking said locking element in its locking position against manual unlocking and a releasing position liberating the locking element. For energizing the first and second electric drives there is provided a drive current circuit having two current paths connected in parallel with one another. The first current path contains the first drives connected in parallel with one another. The second drives are connected in parallel into the second current path. Two controllable drive current switches are connected to the drive current circuit. The first drive current switch switches on the drive current circuit in the locking direction of the first drives and the blocking direction of the second drives. The second drive current switch switches on the drive current circuit in the unlocking direction of the first drives and the releasing direction of the second drives. At least one first control switch is actuable by means of a key operating said door lock. A time control means connected to the drive current switches and to the first control switch switches on the drive current circuit in a first switch position of the first control switch for a predetermined time duration via the first drive current switch. In a second switch position of the first control switch the time control means switches on the second drive current switch for a predetermined time duration. At least one second control switch is connected in series with the second current path containing the second drives. The second control switch is also actuable by means of said key.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

In the drawings:

In FIG. 1 there is shown in longitudinal section a complete actuator element S for a central locking apparatus. In a dividable housing 1 there is longitudinally displaceably mounted an actuator member 2 or push rod which is provided with a protruding attachment end for connection with a fastening or locking rod 32 of a door lock 33, which is situated for example in one of the doors 34 of a motor car. The longitudinally movable actuator member 2 or push rod is sealed off from the housing 1 by means of a cover cap 3. The push rod 2 is sprung in its end positions by rubber blocks 4 which are arranged in a window-type aperture 2*c* of the push rod, adjacent to its attachment end. The rubber blocks 4 place themselves at the end positions alternately against a stop pin 1*a* secured in the housing 1. The stop pin 1*a* in turn is enclosed with clearance in the aperture 1*c* of the movable push rod 2. The push rod 2 is provided in its longitudinal axis with a rack 2*a* meshing with a drive pinion 5 of a reduction gear wheel 6.

As shown in FIGS. 2 to 4, the reduction gear wheel 6 comprises means for producing an idle rotation distance in each direction of drive rotation. In a concentric aperture in the gear wheel 6 a drive dog 7 is provided which can co-operate alternately with circumferentially directed stops 8*a* disposed at a given angle to one another on a concentric disc part 8 engaging in the concentric aperture of the gear wheel 6. The disc part 8 accommodates a small part of the axial length of the above-mentioned pinion 5 in an internally toothed opening fixed in rotation. The reduction gear wheel 6 is in constant engagement with a pinion 9 of a direct-current drive motor 10 within the housing 1. The shaft of the motor 10 is carried in a bearing in the upper part of the housing 1. The end of the longitudinally movable actuator member 2 which protrudes into the left region of the housing 1, in FIG. 1, is provided with an appropriately bevelled end for the mechanical actuation of a switch-over contact 19 which is connected through plug connector contacts 20 with a control circuit 21 (central electronic system).

Figure 1:
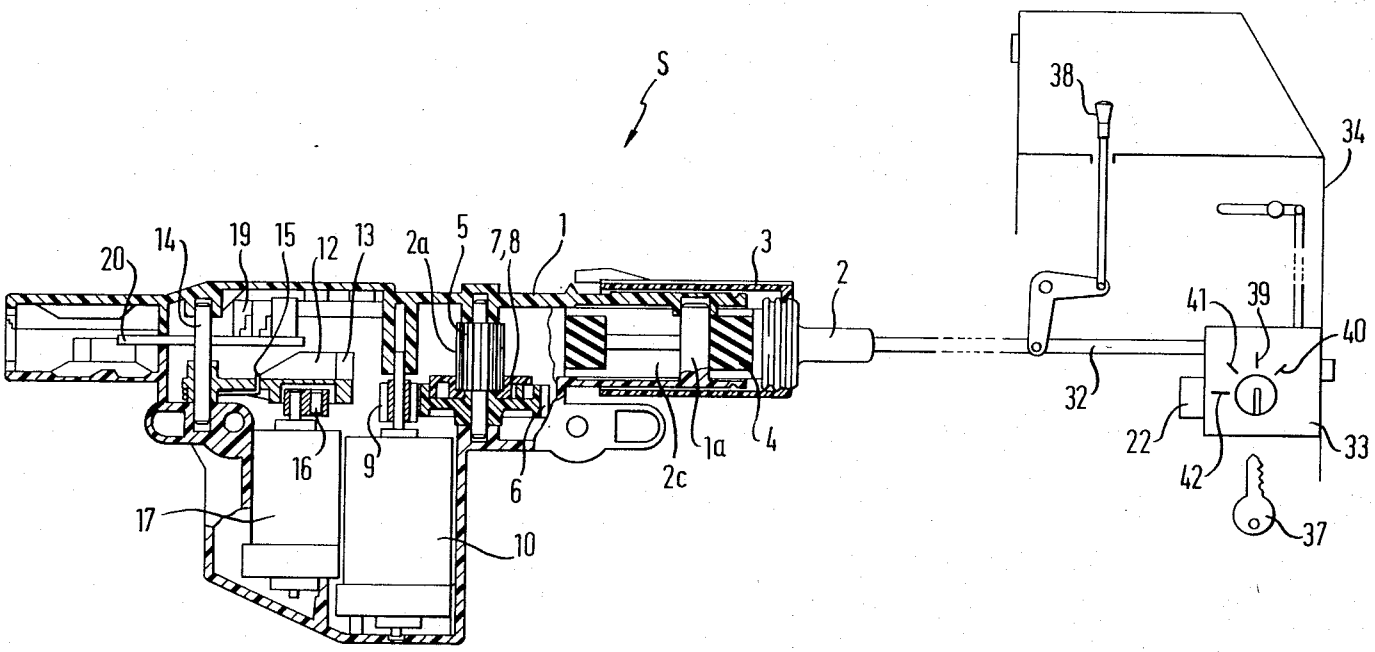
FIG. 1 shows a central locking actuator element with anti-release catch integrated into the housing, in sectional view, and with door lock represented diagrammatically.

On the inner end of the actuator member 2 there is provided, as may be seen especially from FIGS. 2 to 6, a hook part 11 which can co-operate with a catch pawl part 12 provided with a counter-hook 13. The catch pawl part 12 is pivotably articulated, as may be seen from FIG. 1, on a spindle 14 in the plane of the pinion 9. The catch pawl part 12 is on the one hand under the influence of a return spring 15 and on the other hand pivotable by means of an actuator eccentric 16 which is arranged on the shaft of a direct-current motor 17, which in turn is accommodated axially parallel with the motor 10 in the housing 1.

As already mentioned, in FIGS. 2 to 6 the actuator member 2 is illustrated in operational examples. In order to achieve an especially clear representation here only the actuator member 2, the drive system with the parts 5 to 10 and the arrangement of the catch pawl part with the references 11 to 17 are shown diagrammatically.

Figure 2:
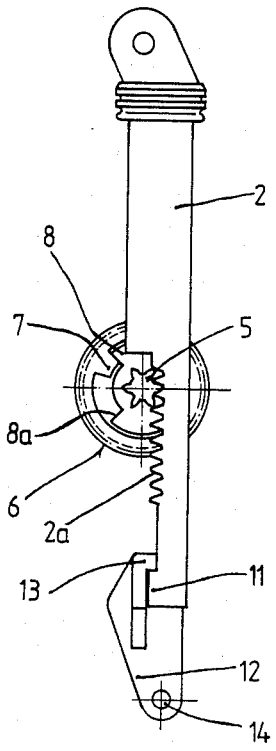
FIG. 2 shows the actuator member of the central locking actuator element in the form of a rack with pinion drive in the "locked and secured" position.

FIG. 2 shows the actuator member 2 or push rod of the central locking actuator element S in the "locked and secured" position. The actuator member 2 is situated, after appropriate driving by the pinion 5, in the lower position; the rack 2*a* fixedly arranged on the actuator member 2 is in engagement by its uppermost region with the non-displaceable pinion 5. The hook end part 11 of the actuator member 2, in this "locked and secured" operational position, is overgrasped by the catch pawl part 12, 13 which is pivoted inwards against the return spring 15, and is thus locked mechanically against a still possible longitudinal unlocking movement (upward in FIG. 2). "released or unsecured" operational position in which the above-described securing against release has become ineffective. By actuation of the motor 17 the actuator eccentric 16 has been rotated, whereby the catch pawl part 12 with its counter-hook 13 has been pivoted out of the former operative position blocking the hook end 11 of the push rod 2. The motor 17 and the drive motor 10 have started up simultaneously, whereby the drive dog 7 situated in the reduction gear wheel 6 has run in the counter-clockwise direction and abuts delayed on the stop flank 8*a* of the stop part 8.

Figure 4:
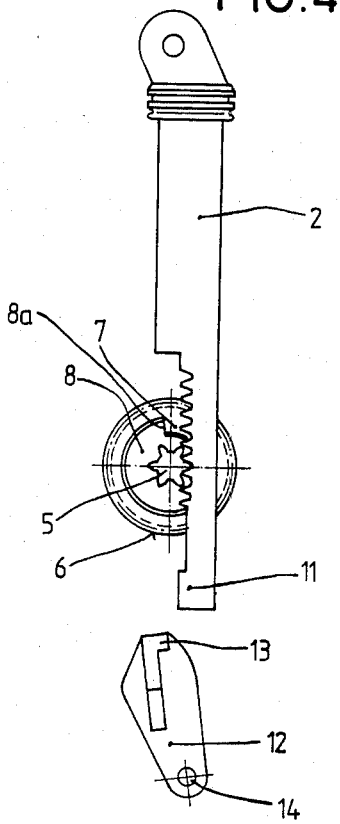
FIG. 4 shows the actuator member according to FIG. 2 in the "unlocked, released" position.

FIG. 4 shows the operation of unlocking. The motor 10 rotates further, so that the pinion 5 moves the rack 2*a* and the actuator member 2 coupled therewith is displaced fully upwards into the "unlocked" position unlocking the door lock.

Figure 5:
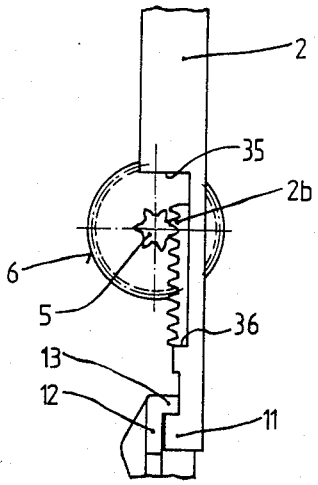
FIG. 5 shows another form of embodiment of an actuator member of a central locking actuator element with linearly displaceable rack, in the "locked and secured" position, in elevation.
Figure 6:
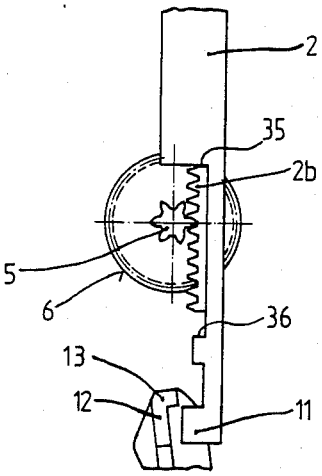
FIG. 6 shows the actuator member according to FIG. 5 in the "unlocked, released" position.

Another embodiment of the actuator member 2, as regards the drive arrangement, is shown in FIGS. 5 and 6. The configuration of the hook end 11 on the actuator member and that of the catch pawl parts 12, 13 are the same as in the example according to FIGS. 2 to 4. The drive of the actuator member 2 of the embodiment according to FIGS. 5 and 6 however differs in that the rack 2*b* is fitted on the actuator member 2 not non-displaceably, but limitedly longitudinally displaceably between stops 35 and 36. The drive of the actuator member 2 is effected by means of the pinion 5, which is driven directly by the reduction gear wheel 6 without interposition of an idle rotation distance system. As may be seen from FIG. 5, the actuator member 2 is represented in the "locked and secured" position. The operation of unlocking proceeds in this embodiment as already described in connection with the example of embodiment according to FIGS. 2 to 4. The electric motor 10, energised simultaneously with the motor 17 for the anti-release catch, firstly drives the pinion 5 and thus the rack 2*b* which is moved upwards in the direction of the longitudinal axis out of the "locked and secured" position shown in FIG. 5, initially alone, as FIG. 6 clearly shows, while the catch pawl part 12, 13 comes out of engagement. Only after the idle distance provided for the rack 2*b* has been travelled, after abutment of the rack 2*b* on the upper end region, does a longitudinal displacement of the actuator member 2 itself take place through the already described drive by way of pinion 5 and gear wheel 6.

Figure 7:
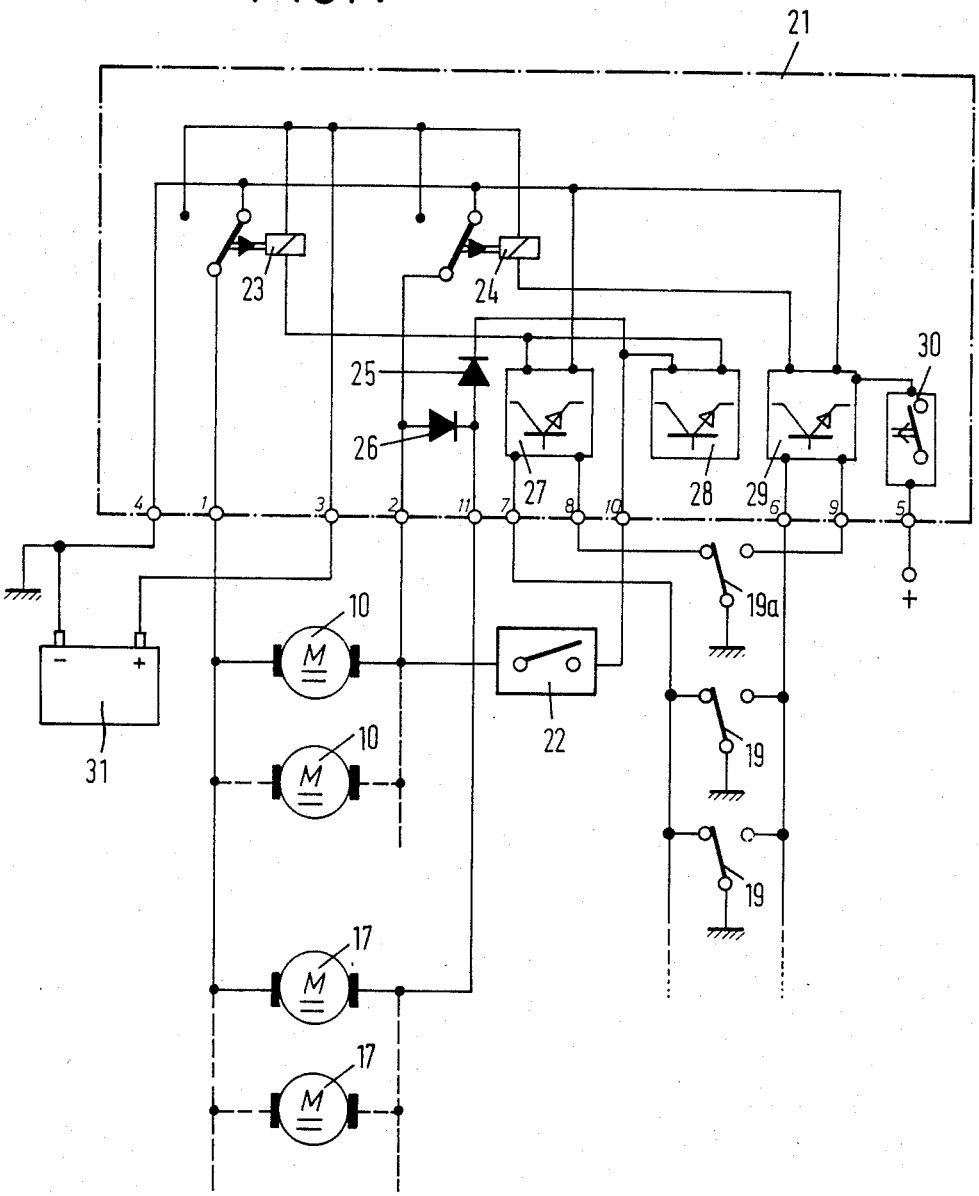
FIG. 7 shows a circuit diagram of the time control system for the central locking apparatus with anti-release catch formed in accordance with the invention.

FIG. 7 shows a circuit diagram of the control circuit 21 for the central locking apparatus as represented by way of example in FIGS. 1 to 6 and explained above. This control circuit 21 comprises a control switch 22 allocated to the door lock in the driver's door, possibly also in the front passenger's door. The control switch 22 is actuatable by means of the door lock key by a key rotation proceeding beyond the locking position of the key. In this position of the door key the control switch 22 actuates a time member 28. The output of the time member 28 is electrically in parallel with the output of a time member 27 and actuates a relay 23 whereby, through a diode 25 and the control switch 22, the motors 17 for the anti-release catch are switched on. It should be emphasised here that the electric motors 10 and 17 for the door-locking members and for the associated anti-release catch members, for the execution of a control command, are connected electrically in parallel through the diodes 25 and 26 and the control switch 22. Only the diode 25 and the control switch 22 are effective in the closing direction, while in the case of a control command in the opening direction the other diode 26 alone is effective. For both functions, namely "locking" and "securing" and for "unlocking" and "release" the relays 23 and 24, already present in any case in the central locking installation, will expediently be used. In the closing direction the electric motors 17 of the anti-release catches will be connected electrically in parallel with the electric motors 10 of the locking elements, by means of the control switch 22. At the same time a closure command is given through this switch 22 to the control circuit 21, whereby the electric motors 10 of the locking elements and also the electric motors 17 of the anti-release catch will be energised. The closure command is carried out by both motors—10 and 17—practically simultaneously. The control circuit 21 in addition to the above-mentioned elements comprises a jolt or acceleration sensor, known as a crash sensor 30. The current for all operations is supplied by a vehicle battery 31.

In the execution of a control command in the opening direction upon triggering the time stage 29 by means of a switch-over contact 19 in the actuator element S (FIG. 1), the electric motors 10 and 17 are connected electrically in parallel by means of the diode 26. During the execution of the opening control command to both motors 10 and 17 a short time delay is provided between the beginning of movement of the above-mentioned catch pawl 12 and the push rod 2, so that firstly the above-described co-operating catch elements 11 and 12 can disengage and thus the push rod 2 is liberated for a movement in the opening direction of the door lock fastening.

For this purpose in accordance with the invention the above-mentioned idle motion coupling is provided in the mechanical drive path of the actuator member (push rod 2), for example in the form of the idle rotating movement coupling with the parts 6, 7, 8 and 8*a* according to FIGS. 1 to 4 or the idle longitudinal movement coupling with the parts 2, 2*b*, 5 and 6 according to FIGS. 5 and 6.

Figure 3:
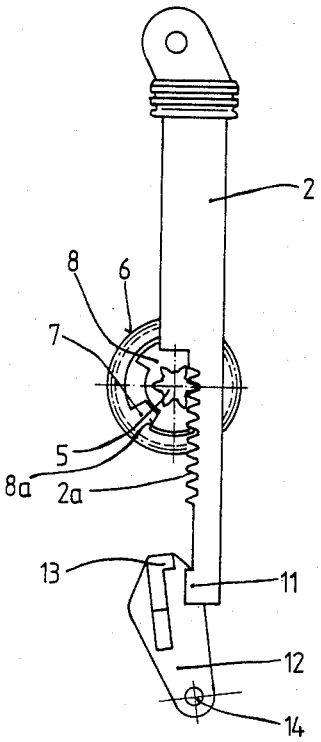
FIG. 3 shows the actuator member according to FIG. 2 in the "locked, unsecured" operating position.

The design of the mechanical idle motion coupling in the form of an idle rotating movement coupling according to FIGS. 2 to 4 has the special advantage that the effective cross-section of the push rod 2 with formed-on rack, which may take up locking forces, is not weakened in the toothing region, compared with the embodiment according to FIGS. 5 and 6.

As well as the above-mentioned mechanical idle motion coupling it is also conceivable to provide in the control circuit arrangement an electrical delay device, for example by means of a series connection of thermal switches.

The manner of operation of the control circuit according to FIG. 7 is to be explained in greater detail below. As already mentioned, 19 designates change-over switches actuatable by means of the actuator element S of the door or the connecting linkage between lock and actuator element when mechanically locking or unlocking the door lock. 19*a* designates a change-over switch which is actuatable in the locking of the boot lock, through the associated actuator element. The switch 19 or 19*a* is actuated in the manual shifting of the actuator element or of the associated linkage during the manual locking or unlocking of the lock 33 by means of the key 37 from the exterior or of a "fastening knob" 38 of the door from the interior. Through the electronic control circuit 21 the control switches 19 of the other actuator elements are likewise switched over. For securing or blocking the push rod 2 of each actuator element S the additional switch 22, for example actuatable from the lock of the driver's door, is provided, which is closed by a rotating movement of the key going beyond the closed position for example of the driver's door lock. In FIG. 1 the rest position of the lock 33 is indicated at 38, its unlocking position at 40, its locking position at 41 and its securing or blocking position, in which the control switch 22 is closed, is indicated at 42.

The motors 10 and 17 are controlled by the time member 27, 29 through a pole-reversing circuit formed from the two switch-over relays 23 and 24. The relay 23 switches on the motors 10 in the locking direction and the motors 17 in the securing direction. The relay 24 switches on the motors 10 in the unlocking direction and the motors 17 in the unsecuring or releasing direction. On triggering the time members 27, 28, 29 each outputs pulses to the relays of the pole-reversing circuit which switch over the relays, for the duration of the pulse, into the position in each case other than that represented in FIG. 7. The relay 23 is controlled by time members 27 and 28. The time member 27 is tripped in the manual locking of a door lock through the switch 19 or in the locking of the boot lock through the switch 19*a*. The time member 28 is tripped through the switch 22. The time member 29 controls the unlocking relay 24 and is triggered in the other position by the switches 19 and 19*a*.

In the locking operation, initiated by the switches 19 and 19*a*, the motor current of the motors 10 flows from the plus terminal of the battery 31 through the contact of the relay 23, the motors 10, the contact of the relay 24 to the minus terminal of the battery 31. The motors 17 are not switched on in the locking of the locks initiated through the switches 19, 19*a*, since the switch 22 is opened.

For the anti-theft securing of the locks the current of the motors 17 flows from the plus terminal of the battery 31 via the contact of the relay 23, the motors 17, the diode 25, the closed switch 22, the contact of the relay 24 to the minus terminal. At the same time current flows through the motors 10, which thus are switched on in addition. Thus in securing operation the motors 10 are actuated by two successive current pulses, since the driver's door key is turned past the locking position into the anti-theft securing position. Thus it is ensured that the rack 2, applying itself resiliently to end stops, in the anti-theft securing operation is situated in a position in which the pawl 12 can snap into engagement.

In the unlocking and unsecuring by means of the switches 19, 19*a* the current flows from the plus terminal of the battery 31 through the contact of the relay 24 on the one hand through the diode 26, the motors 17 and thence through the contact of the relay 23 to the minus terminal of the battery 31 and on the other from the contact of the relay 24 through the motors 10 likewise through the contact of the relay 23 to the minus terminal. In unlocking and unsecuring the motors 10 and 17 are thus switched on at the same time. The design of the actuator members ensures that the push rod is released from pawl engagement before the drive force of the motor 10 becomes effective.

While specific embodiments of the invention have been shown and described in detail to illustrate the application of the inventive principles, it will be understood that the invention may be embodied otherwise without departing from such principles.

What is claimed is:

1. Central locking installation for motor vehicle door locks or the like each having a locking element movable between a locking position, blocking said door lock and a position unlocking said door lock comprising:

(a) a first electric drive means for each locking element to be driven, which drives said locking element in a direction towards said locking position and a direction towards said unlocking position, (b) a second electric drive means and for each locking element a blocking member movable by said second drive means in a blocking direction and a releasing directiion between a blocking position blocking said locking element in its locking position against manual unlocking and a releasing position releasing said locking element resp., (c) a drive current circuit having two current paths connected in parallel with one another, of which the first current path contains said first drive means connected in parallel with one another and the second current path contains said second drive means connected in parallel with one another, (d) two controllable drive current switches connected to said drive current circuit, of which the first drive current switch switches on said drive current circuit in said locking direction of said first drive means and said blocking direction of said second drive means and of which the second drive current switch switches on said drive current circuit in said unlocking direction of said first drive means and said releasing direction of the second drive means, (e) at least one first control switch switchable between a first and a second switch position, at least one of said first control switches being actuatable by means of a key operating said door lock, (f) a time control means connected with said drive current switches and said first control switch, said time control means switching on said drive current circuit in said first switch position of said first control switch for a predetermined time duration through said first drive current switch and in said second switch position of said first control switch for a predetermined time duratiion through said second drive current switch, (g) at least one second control switch in series with said second current path containing said second drive means, said second control switch being actuatable by means of said key through said door lock which actuates the first control switch.

2. Central locking installation according to claim 1, characterized in that in series with said second current path containing the second servo-drives, two diodes are connected with opposite polarities, the first diode being connected in series with said second control switch and the second diode being connected in parallel with said series connection of said first diode and said second control switch.

3. Central locking installation according to claim 2, characterized in that said first diode is polarized in the forward direction for the drive current of said drive current circuit switched on by said first drive current switch.

4. Central locking installation according to claim 1, characterized in that said time control means is connected with said second control switch and on actuation of said second control switch switches on said drive current circuit, through said first drive current switch independently of the switch position of said first control switch, for a predetermined time duration.

5. Central locking installation according to claim 4, characterized in that said door lock, which is switchable by means of said key and actuates said first control switch and said second control switch, in a first key position switches said first control switch into its first switch position, in a second key position switches said first control switch into its second switch position and in a third key position, placed on the side of said second key position remote from said first key position, actuates said second control switch.

6. Central locking installation according to claim 1, characterized in that an idle-motion coupling is provided in the force transmission path between said first drive means and the locking element of said door lock, permitting a predetermined mechanical play of the drive movement of said first drive means in relation to the drive movement of said locking element, and in that said blocking member moved by said second drive means blocks the force transmission path on the locking element side of the idle-motion coupling.

7. Central locking installation according to claim 6, characterized in that said first drive means, through a gear wheel, drives a linearly movable rack coupled with said locking element, said rack being seated with play longitudinally displaceably between two stops of a rod which is displaceable in the same direction and is coupled with said locking element.

8. Central locking installation according to claim 6, characterized in that said first drive means, through a gear wheel, drives a rod provided with a longitudinal toothing and coupled with said locking element, and in that in the rotating movement drive path between said first drive means and said gear wheel there are provided two coaxial coupling elements mounted rotatably in relation to one another, of which each coupling element comprises a pair of stop faces arrangened with angular spacing from one another and facing in opposite circumferential directions, the stop faces of one of said two coupling elements being arranged in the path of rotation between the stop faces of said other coupling element.

9. Central locking installation according to claim 7 or 8, characterized in that said blocking member in its securing position engages in blocking manner with said rod.

* * * * *